US007448097B2

(12) United States Patent
Cancian

(10) Patent No.: US 7,448,097 B2
(45) Date of Patent: Nov. 11, 2008

(54) RETRACTABLE SHOWER SUPPORT

(75) Inventor: Danny Cancian, Raumati Estate (NL)

(73) Assignee: Buddy Corporation Limited (NZ)

( * ) Notice: Subject to any disclaimer, the term of this patent is extended or adjusted under 35 U.S.C. 154(b) by 331 days.

(21) Appl. No.: 11/011,305

(22) Filed: Dec. 14, 2004

(65) Prior Publication Data

US 2005/0166312 A1 Aug. 4, 2005

(30) Foreign Application Priority Data

Feb. 4, 2004 (NL) ..... 530906

(51) Int. Cl.
*A47K 3/022* (2006.01)

(52) U.S. Cl. ..... 4/604; 4/611

(58) Field of Classification Search ..... 4/604, 4/611, 573.1–579; 5/81.1 HS, 81.1 R
See application file for complete search history.

(56) References Cited

U.S. PATENT DOCUMENTS

| | | | | |
|---|---|---|---|---|
| 1,386,160 | A * | 8/1921 | Loucien | 384/494 |
| 3,107,947 | A * | 10/1963 | Hulterstrum | 384/418 |
| 4,757,561 | A * | 7/1988 | Crump | 4/604 |
| 5,097,542 | A * | 3/1992 | Roesler | 4/579 |
| 5,558,022 | A * | 9/1996 | Mason et al. | 104/126 |
| 5,561,868 | A * | 10/1996 | Campbell | 4/560.1 |
| 5,606,751 | A * | 3/1997 | Baker | 4/560.1 |
| 5,903,935 | A * | 5/1999 | Huelke | 4/560.1 |
| 6,256,806 | B1 * | 7/2001 | DiTommaso | 4/560.1 |
| 6,340,205 | B1 * | 1/2002 | Battiston | 297/24 |
| 6,941,592 | B1 * | 9/2005 | Castillo | 4/560.1 |

* cited by examiner

*Primary Examiner*—Khoa D Huynh
(74) *Attorney, Agent, or Firm*—Carol A. Marmo; Eckert Seamans Cherin & Mellott, LLC

(57) ABSTRACT

A retractable shower support (A), typically a retractable shower chair, for moving an invalid in and out of a shower, wherein the retractable shower support (A) includes (i) at least a pair of elongate frame members (C), (D), connected to one another by a hinge mechanism such that each elongate frame member (C), (D) is adapted to be pivoted about the hinge mechanism between a stowed position and an erected position and whereby, when in the erected position, the upper surfaces of the elongate frame members are aligned in the same plane and at least one of the pair of elongate frame members is adapted to extend into a shower cavity, (ii) a platform (23) slidably mounted to an upper surface of the elongate frame members (C), (D) to enable the platform (23) to be slid back and forth along the elongate frame members (C), (D), and (iii) an invalid support means (B) mounted to an upper surface of the platform (23), wherein the invalid support means (B) is adapted to be moved from an upright position when in use, and in a lowermost position when not in use.

When the elongate frame members (C), (D) are in an erected position and the invalid support means (B) is in the upright position, an invalid positioned on the invalid support means (B) is adapted to be slid back and forth along the elongate frame members (C), (D) so as to be moved in to and out of the shower cavity. The retractable shower support (A) is adapted to be stowed, when not in use, by lowering the invalid support means (B) to a lowermost position and the elongate frame members (C), (D) folded in half about the hinge mechanism for storing and transportation of the retractable shower support (A).

26 Claims, 8 Drawing Sheets

RETRACTABLE SHOWER SUPPORT

FIELD OF INVENTION

This invention relates to a retractable shower support, typically a shower chair, for supporting a person, typically a disabled person, in a shower.

BACKGROUND OF INVENTION

The washing of persons with physical ailments or disabilities can be an onerous task none more so than when such persons are being washed in a shower.

The problem with standard showers is that they are very awkward to get in and out of, as they can be very slippery when wet, for people with disabilities. There is also greater risk of the caregiver injuring themselves by slipping over in the shower while holding a disabled person.

There have been many cases of people injuring themselves when being placed placed in and out of showers by caregivers The caregivers usually get wet and don't have as much control since one hand is used to hold and the other to clean. Generally, disabled people need to have special wet area showers built for them which can be of great expense and not always practical. Also, if the person needs to go way from home they can not take the shower with them.

A lot of physically disadvantaged or disabled people find the experience of showering by a stranger trying to manoeuvre them into a small area very undignified and embarrassing.

The current solutions are generally big and very bully and are not easily transportable. Thus disabled people become much more house bound and do not venture out of there homes for holidays and/or be part of normal society.

Caregivers using known showering devices have to hold on to patients and try to manoeuvre them in and out of the shower at great risk of slipping over and hurting themselves and the patient.

A current solution is to build a wet area shower at a very big cost to the home owner and/or government or charitable agencies. A shower chair can be used in such a wet area shower but not in a standard shower unit because the caregiver has to lift the chair over the shower tray and try to shower the patient with no room to move in and around the patient.

The disadvantage with the entire prior art is that they can not be easily transported from one place to another and are very impractical because they take up a lot of space such that if these items are left in a shower or bathroom there is no room for anyone else to move.

OBJECT OF THE INVENTION

It is an object of the invention to provide a retractable shower support, typically a shower chain, for supporting a person (hereinafter called an "Invalid") in a shower that seeks to ameliorate the disadvantages or limitations of the prior art or at least provide the public with a useful choice.

STATEMENT OF INVENTION

In a first aspect the invention resides in a retractable shower support, typically a retractable shower chair for moving an invalid in and out of a shower, wherein the retractable shower support includes (i) at least a pair of elongate frame members, wherein the elongate frame members are connected to one another by a hinge mechanism such that each elongate frame member is adapted to be pivoted about the hinge mechanism between a stowed position and an erected position and whereby, when in the erected position, the upper surfaces of the elongate frame members are aligned in the same plane and at least one of the pair of elongate frame members is adapted to extend into a shower cavity, (ii) a platform slidably mounted to an upper surface of the elongate frame members to enable the platform to be slid back and forth along the elongate frame members, and (iii) an invalid support means mounted to an upper surface of the platform, wherein the invalid support means is adapted to be moved from an upright position when in use, and in lowermost position when not in use, wherein, when the elongate frame members are in an erected position and the invalid support means is in the upright position, an invalid positioned on the invalid support means is adapted to be slid back forth along the elongate frame members so as to be moved in to and out of the shower cavity and further wherein the retractable shower support is adapted to be stowed when not in use the invalid support means is in the lowermost position and the elongate frame members folded in half about the hinge mechanisms for storing and transportation of the retractable shower support.

In a further aspect the invention resides in a retractable shower support, typically a retractable shower chair, for moving an invalid in and out of a shower, the retractable shower support includes:

(i) at least one elongate frame member upon which a platform is adapted to slide between a first position and a second position, (ii) an invalid support means adapted to support an invalid, wherein the invalid support means is releasably mounted to an upper surface of the platform and is adapted to move from an upright position, when in use, to a lowermost position when not in use, wherein, when in use, a first portion of the elongate frame member is adapted to extend into a shower cavity and a second portion of the elongate frame member is adapted to extend outside the shower cavity whereby the upper surfaces of said first and second portions are aligned in the same plane, such that an invalid is capable of being positioned on the invalid support means when the platform is at the first position when situated over the second portion of elongate frame member and the invalid is capable of being positioned within the shower cavity when the invalid support is slid to a second position situated over the first portion of the elongate frame member and further wherein, when not in use, the invalid support means is capable of being lowered to the lowermost position and the elongate frame member folded about a hinge mechanism pivotally connecting the first and second portions together, typically in half, so that retractable shower support is capable of being easily stowed and/or transported Preferably, invalid support means when in the lowermost position is adapted to be detachable from the platform so that retractable shower support is able to be easily stowed and/or transported.

Preferably, the platform includes two portions, a lower portion and an upper portion, wherein the upper portion is rotatably connected to the lower portion such that the upper portion is adapted to rotate relative to the lower portion, thereby enabling the upper portion and the invalid support means to rotate 360° relative to the elongate frame members to allow an invalid a full range of movement within the shower, the lower portion is slidably mounted to the upper surface of the elongate frame members to enable the platform to be retracted back and forth along the elongate frame members.

Preferably, the elongate frame members include a track in which wheels mounted to the platform are adapted to move back and forth so as to allow the invalid support means to be retracted in and out of the shower cavity.

Preferably, each elongate frame member has at least two support legs connected to the under surface of each respective elongate frame member wherein the support legs are adapted to support the elongate frame members at a predetermined height above the floor and above the highest most point of a shower tray.

Preferably, one of the support legs of each elongate free member is adapted to be adjusted vertically so that height of the retractable shower support is adapted to allow the retractable shower support to be level.

Preferably, all support legs are adjustable.

Preferably, the platform has an aperture therein, typically in the centre of the platform, so the water can easily pass therethrough.

Preferably, the platform has foot rests so that the feet of the invalid on the invalid support means can rest and prevent the feet being injured when moving the invalid support means in and out of the shower.

Preferably, each elongate frame member is hinged at the centre to allow the elongate frame members to be folded in half for storing and transportation.

Preferably, the wheels are nylon wheels or ball bearing wheels.

Preferably the platform has locking means adapted to prevent the platform from moving when an invalid is being loaded on and off the invalid support means.

Preferably, the locking means are locking bolts, or pins, wherein the locking bolts or pins are adapted to engage with co-operating apertures on the elongate frame members.

Preferably, the invalid support means is a chair having a seat, four legs depending downward from the seat, a back support and two arm rests.

Preferably, the seat, legs, back support are pivotably connected to one another.

Preferably, the back legs of the chair are releasably secured to the upper portion of the platform, wherein the chair is adapted to be secured in the upright position for supporting an invalid and adapted to be released therefrom to enable the chair to be lowered to the lowermost position when not in use.

Preferably, the seat is in the form of a toilet seat.

Preferably, the toilet seat is removable for cleaning purposes and/or replacement thereof.

Preferably, the toilet seat or seat is made from plastic material.

Preferably, the arm rests are removable so that an invalid can be placed in and out of the chair when the arm rests are removed and to secure an invalid on the seat when the arm rests are attached.

Preferably, the retractable shower support is made from lightweight, versatile and rigid materials, typically aluminium or plastics material or any other similar suitable known material.

Any other aspect hereinafter described.

BRIEF DESCRIPTION OF THE DRAWING

A preferred embodiment of the invention will now be described by way of example only to the accompanying drawings.

DESCRIPTION OF DRAWINGS

Figure 1:
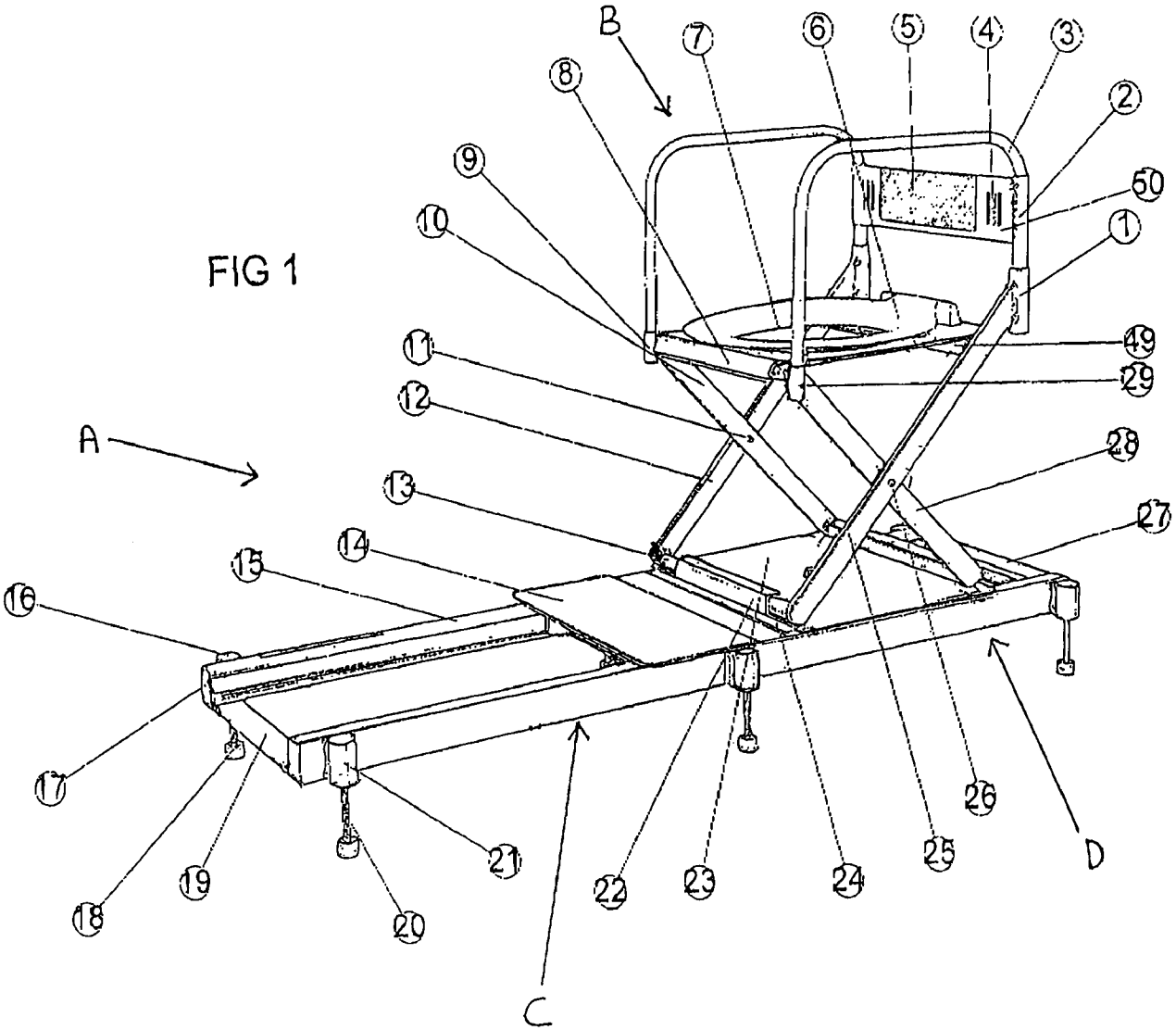
FIG. 1 is a perspective view of an assembled retractable shower support in accordance to a preferred embodiment of the invention.

The retractable shower support shown in FIG. 1 is a preferred embodiment of the invention. The retractable shower support A shown in FIG. 1 is shown in its use position with the chair B situated along a second elongated fame portion D. The chair B has a seat 8 to which downwardly inner and outer legs 10, 28, 12, 25, back rest 5 and removable arms 3. The back rest 5 is releasably attached to the upper portions 1 of the outer legs 12, 25. The front portions of the removable arms 3 are releasably attached to upper portions 9 of the inner legs 10, 28. The back portions of the removable arms 3 are attached to the upper side portions of the back rest 5. The upper portions of the side portions of the back rest and the removable arms are preferably tubular and made from aluminium or plastic material of any similar lightweight material.

The inner and outer legs 10, 28, 12, 25 are shown in FIG. 1 criss-crossing each other and are pivotally fixed to respective inner and outer legs by way of suitable fasteners 11, 26 such as a bolt-nut combination. The back rest 5 is preferably made from rubber material for comfort and can have slots 4 cut into it so that retraining straps can be fitted if the person or invalid needs to be restrained in the chair B.

Figure 7:
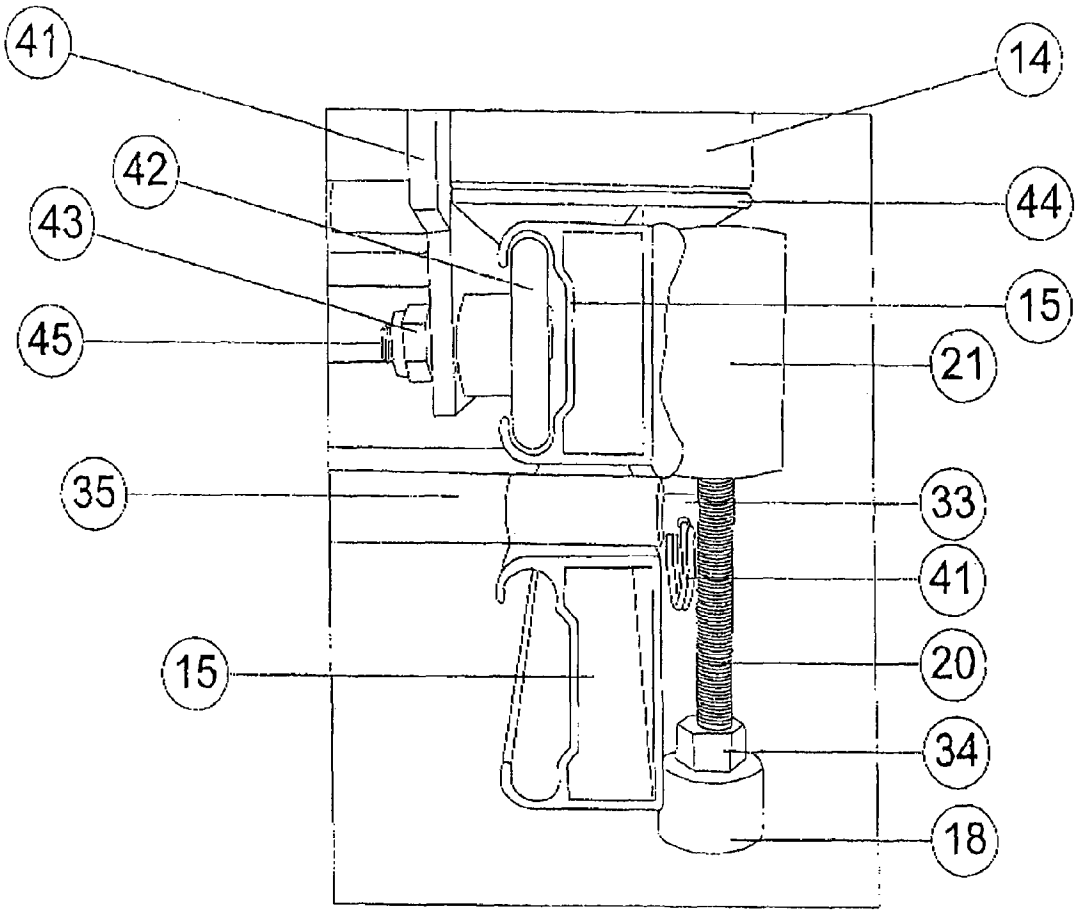
FIG. 7 shows a sliding track arrangement of the retractable shower support in accordance to a preferred embodiment of the invention.
Figure 8:
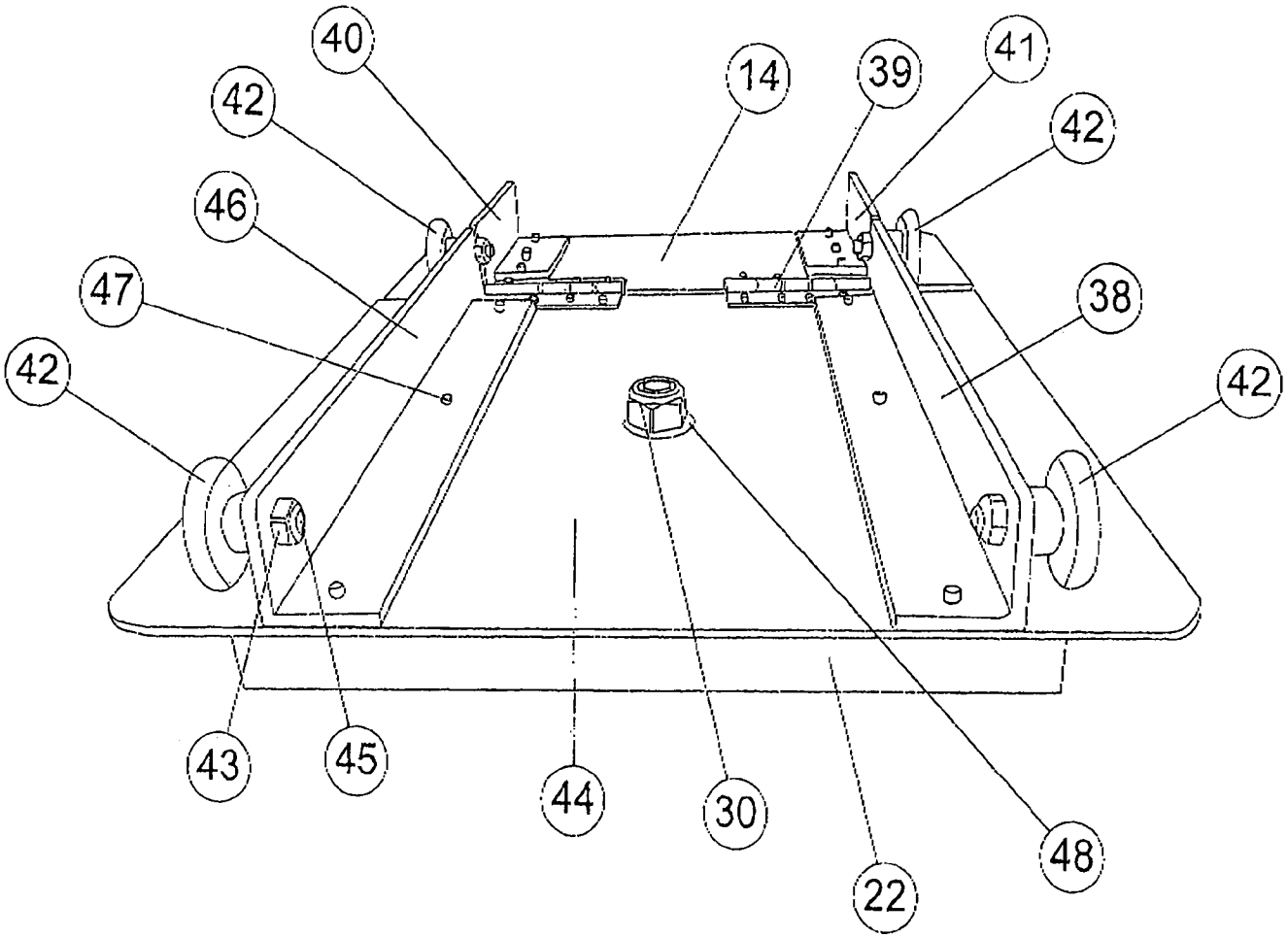
FIG. 8 shows an under surface of the platform of the retractable shower support in accordance to a preferred embodiment of the invention.

The chair is releasably mounted onto a platform having an upper portion 23 rotatably fixed to a lower portion 44 (FIGS. 7, 8). The platform is adapted to slide on tracks 15 of elongate frame member having a first elongate portion C pivotally connected to a second elongate portion D. The elongate frame member has downwardly dependent legs 20, with rubber feet 18, that are typically adjustable mounted to the underside of the elongate frame member to allow the retractable shower support to be positioned and leveled above the floor within and outside the shower and above the highest most point of the shower tray. The legs 18 have a threaded shaft that cooperates within a respective threaded bore within the elongate frame member or within leg supports 16, 21 fixed to the elongate frame member.

Figure 2:
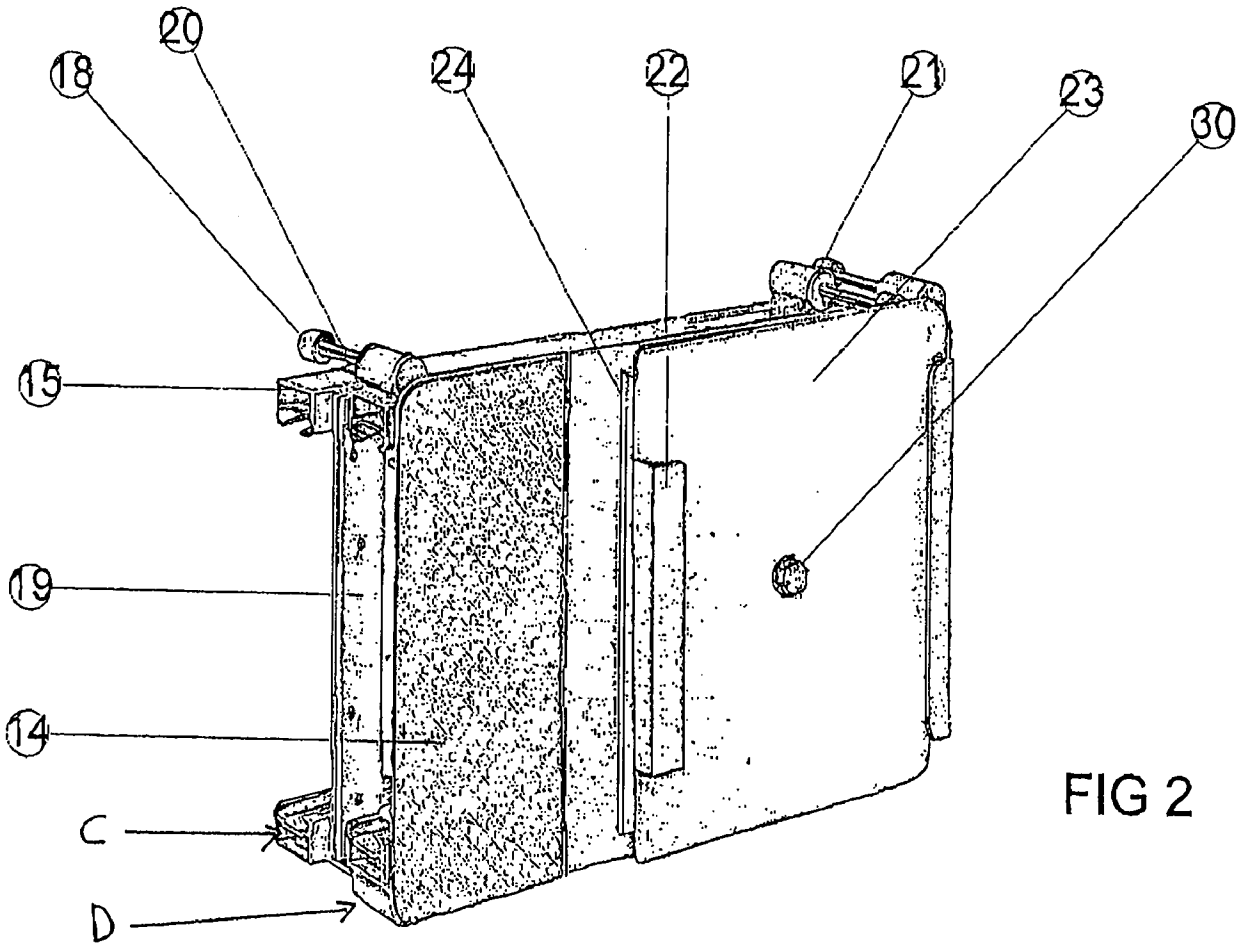
FIG. 2 is a perspective view of a disassembled retractable shower support minus the invalid support means, in accordance to a preferred embodiment of the invention.
Figure 3:
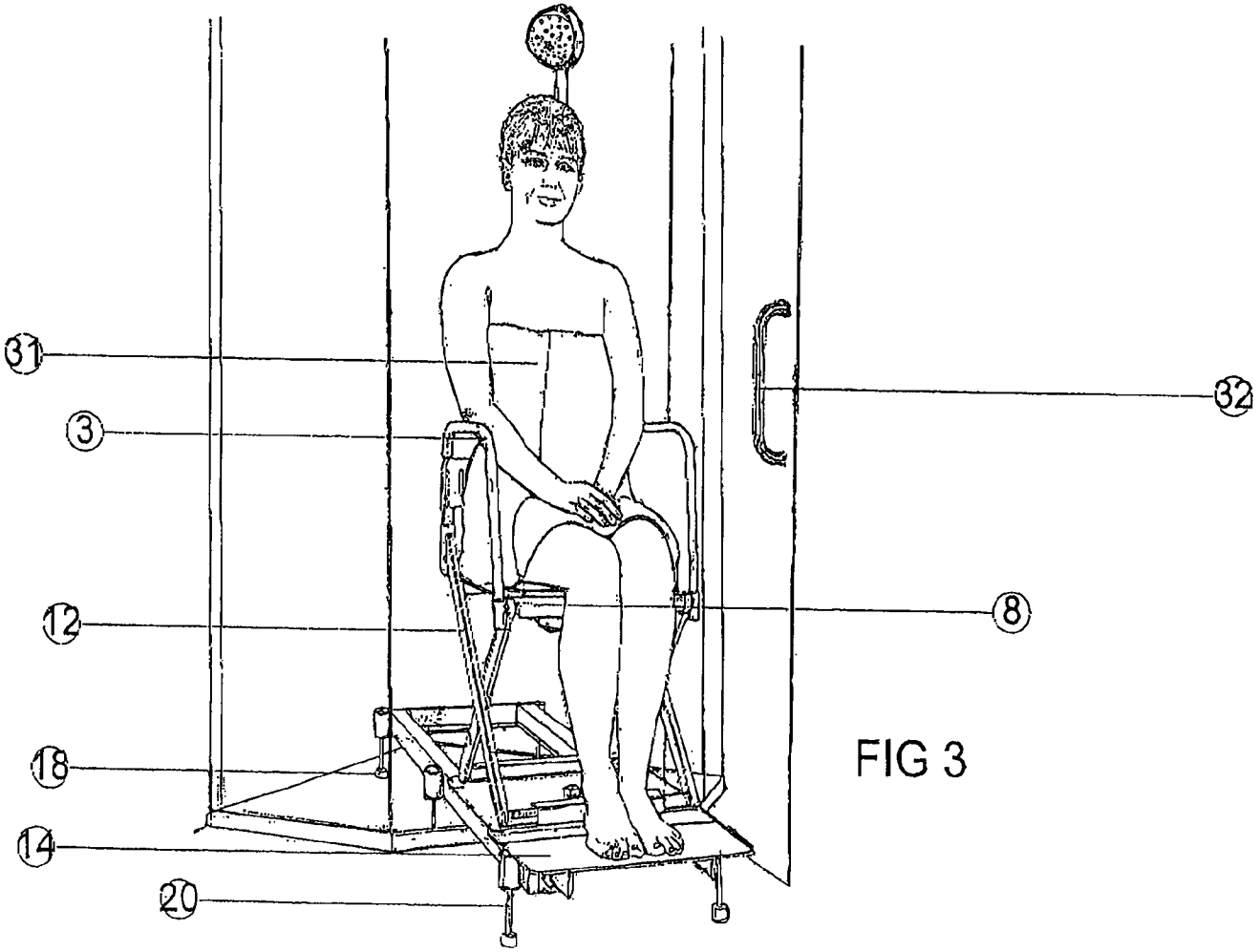
FIG. 3 shows the retractable shower support positioned in a shower cubicle in accordance to a preferred embodiment of the invention.
Figure 5:
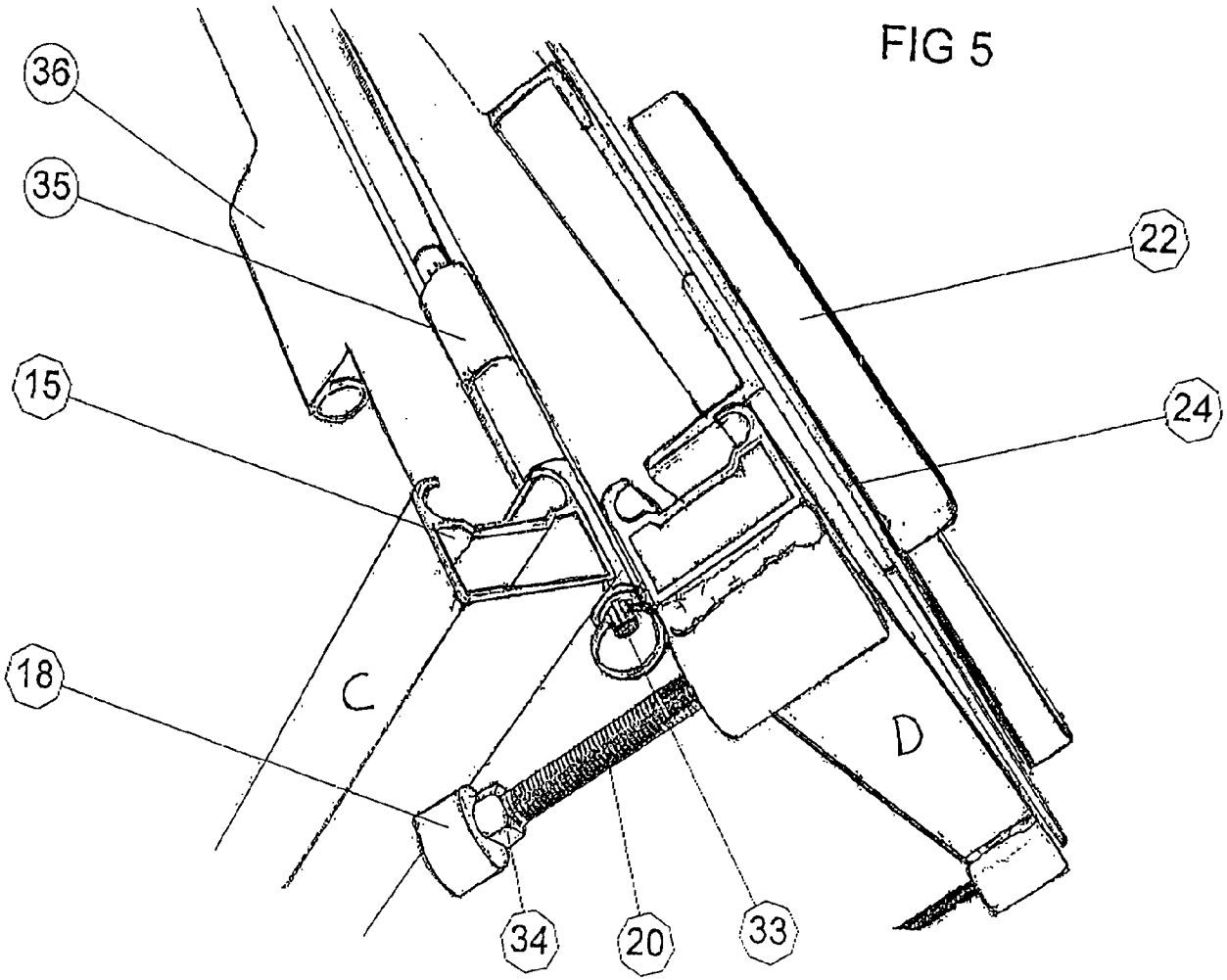
FIG. 5 shows a close up view of the hinging arrangement for the retractable shower support in accordance to a preferred embodiment of the invention.

When not in use or in transit the elongate frame members are folded in half so that the retractable shower support can be stored or transported to another location. FIG. 5 shows the first and second elongate portions C, D in a partial folded state and FIG. 2 shows elongate portions C, D with platform 23 (chair not shown), in a preferred completely folded down state.

The adjustable legs 20 are adapted to keep the elongate frame member level when sliding the chair in and out of the shower and when the floor of the shower tray is higher (which is usually the case) the floor outside the shower.

Figure 6:
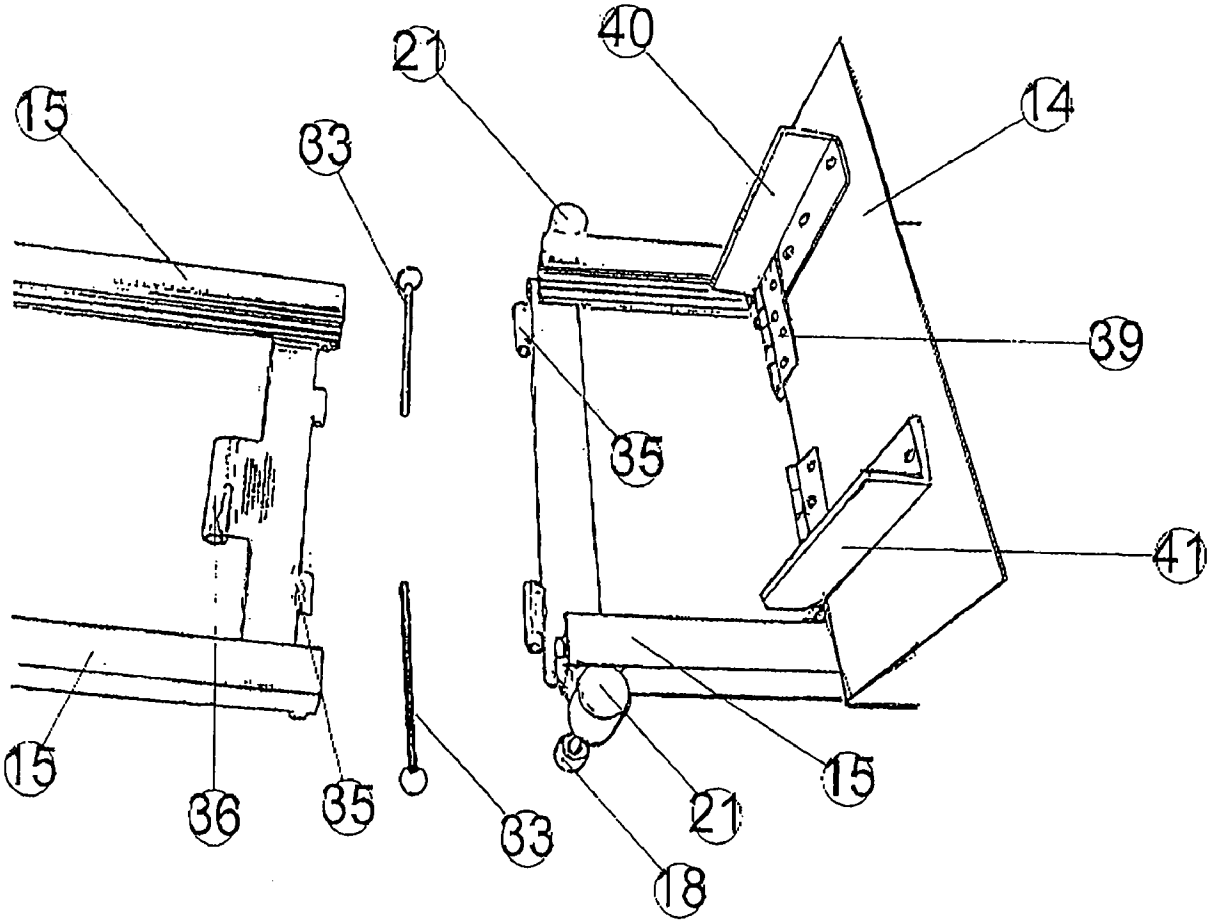
FIG. 6 shows a close up view of a disassembled hinging arrangement in accordance to a preferred embodiment of the invention.

Turning to FIGS. 5 and 6. The first and second portions C, D are pivotally hinged to one another by way of a hinge mechanism consisting of hinge pins 33 and hinge receiving means 35. The hinge mechanism allows the two portions to be rotated about the hinge mechanism and is also readily removeable so that by removing the hinge pins the two elongate portions C, D can be separated. This is very useful in situations where it is desirable to close a shower door or to have access to the invalid within a shower seated on the chair. Elongate portion D is sized and adapted to fit within a shower cubicle and has four feet supporting the elongate portion above the floor of the shower. Elongate portion C is sized and adapted to extend outwardly away from the elongate portion D and preferably has only two feet adjacent and below the free end 19 of the elongate portion C.

The upper portion 23 of the platform has chair leg receiving supports 22 (FIGS. 1, 8). The chair leg receiving supports 22 are adapted to allow the chair to be transported. The chair can further be detached from the platform by removing, one at a time, both the inner and outer legs from the respective chair leg receiving supports 22. As shown in the figures the legs receiving supports 22 are shown as being C-shaped in cross-section and the chair legs are supported in the mouth of the C-shape. It is envisaged other known forms of brackets and clamping arrangements can be used.

Figure 4:
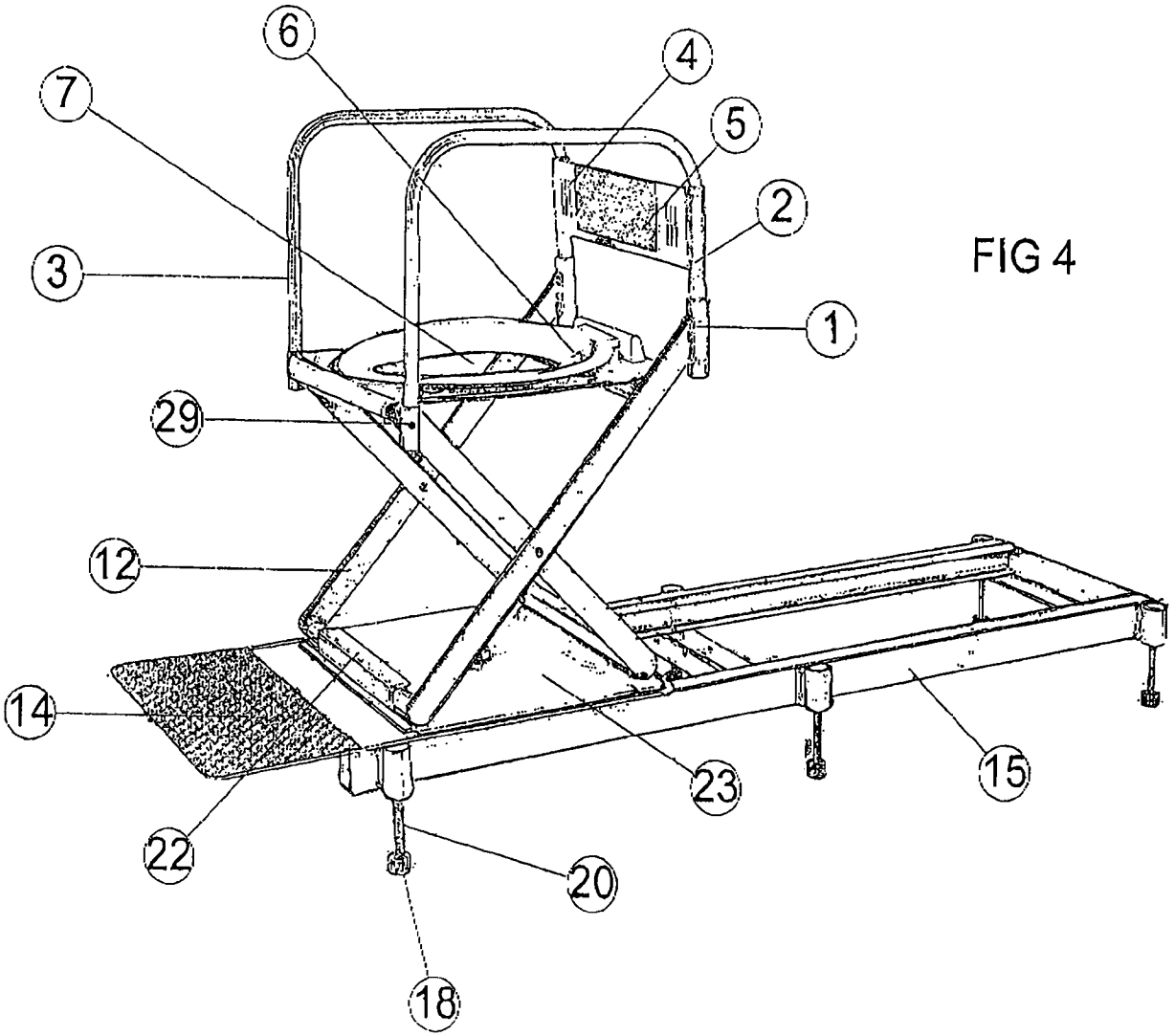
FIG. 4 is a perspective view of an assembled retractable shower support in the invalid loading position, in accordance to a preferred embodiment of the invention.

The upper portion 23 and lower portion 44 of the platform are rotatably joined to one another by way of a bolt/washer arrangement 48, 30. To assist in the relative rotation between the two portions a plastic material, suitably an ultra wipe plastic, is situated between the two portions. The upper portion, and thus the chair, is able to rotate 360° with respect to the lower platform and the rest of the retractable shower support so that the chair can be rotated freely and to any desired orientation to allow the invalid using the retractable shower support full rotational mobility within the shower are thus allow them to be cleaned and showered all over. As shown in FIGS. 1, 4 and 8, there is a foot rest 14 that is pivotally attached via hinges 39 to the lower portion 44 of the platform. The foot rest 14 allows the invalids feet to be supported whilst the invalid is being slide along, the elongate frame member and whilst in the shower. When not in use the foot rest can be raised (as shown in FIG. 6).

Turning to FIGS. 7 and 8, which show the preferred arrangement of the sliding action for the retractable shower support A. The elongate frame member has two parallel track elements 15 configured and adapted to accommodate and allow track wheels 42 fixed to the platform is able to travel. The lower portion 44 of the platform has respective longitudinal wheel supports depending therefrom.

The wheel supports 38, 46 are parallel to and spaced from another a distance which allows the track wheels 42 to run along respective tracks 15 or the elongate frame member. FIG. 8 shows four track wheels 42, two per wheel support, fixed to and adjacent to respective ends of the wheel supports 38, 46. The track wheels are attached to the wheel supports 38, 46 by way of a nut and bolt arrangement 43, 45 such that the wheel is able to rotate freely. It is envisaged that other forms of wheel assemblies can be used, such as a wheel-axle combination. The tracks are preferably c-shaped and adapted to accommodate a wheel 42 having an axle/shaft 45 and a lock nut 43 whereby the axle/shaft 45 passes through an aperture in a bracket 41 and the lock nut fixes to axle/shaft 45 to the bracket 41. The bracket 41 supports the platform 23 so that in use the platform is able to move, via the wheel moving in the track, back and forth in a longitudinal direction along the retractable shower support.

The chair is preferably made of aluminium and will not rust and is lightweight and easily carried by the handle on the side of the track. The size of the retractable shower support is preferably 1400 mm long by 400 mm wide. The retractable shower support is made up of light aluminium and will fit any size shower. Other suitable known materials that are versatile, rigid and lightweight are envisaged to be used in place of aluminium The retractable shower support when showering a physically disadvantaged or disabled person allows for the caregiver not having to get into the wet area with them and thus the caregiver does not slip over or get wet or risk injury. A disabled person is sat on the chair outside the shower and then rolled in to the shower and when they have finished showering they can be slid out of the wet area and dried them off without risk of injuring them or the caregiver. Shower time can be cut in half because you don't have to shower people in a tight space.

Disabled and old people are able to go away on holiday or stay at someone else's house and have piece of mind that they can still shower anywhere as the retractable shower support is portable and easily stored. After use the retractable shower support is able to fold up and stowed in the shower or under the bed or in a cupboard or maybe the boot of a car.

The rubber feet 18 have a 12 mm stainless steel nut molded into them, connected to a 12 mm threaded rod 20 allowing adjustment (up and down). The stainless steel threaded rod 20 is connected to 35×65 mm round solid tube 21 (with a hole tapped down the centre to allow the threaded rod to wind in and out). The 35×65 mm round solid tube 21 is welded to the side profile of the track 15 to support the weight of the unit. The track 15 has 50×20×3 mm angle 19 welded between the tracks to stop flexing of the base unit when varying weights are applied during use. The two sections of track 15 the front and back are connected together by ×2 stainless steel snapping pins 33 so when the shower door is to be shut the front part of the track comes off. (ref FIG. 6).

The front foot rest 14 folds up and down for easy access to the chair, the foot rest 14 is hinged to the lower platform 44 with two 90 mm stainless steel butt hinges 39. There is 50×50×4 mm angle 40-41 riveted under the front foot rest 14 to provided strength it also stops the front foot rest 14)coming in contact with the track 15.

There is a handle 36 in the middle of the track were the unit is hinged 35 for easy lifting. There are four plastic wheels 42 that run up and down the track 15 which are connected to stainless steel wheel shafts 45. The wheel shafts 45 are bolted to 50×50×4 mm angle 18-46 which are riveted to the lower platform 44. The lower platform 44 has ultra wpe plastic 24 riveted to the bottom platform 44 to provide a 360° degree swivel for the top platform 23.

The three levels are bolted together with a central 20 mm stainless steel bolt 30. The chair then clips into the top platform retainers 22 and cannot move. The chair has four 50×12 mm legs 10-12-25-28 fixed together with 10 mm stainless steel bolts 26 which have 25 mm round tube 13 welded at each end of the chair legs which clip into the top platform retainers 22. The seat has two 30 mm tubes 49 welded to the under side of the seat 8 which fits around the 25 mm tube 13 so the seat can move freely up and down. The rubber padded 5 back rest 50 clips into 30 mm tubes 2 welded to the top back legs 25-12 of the chair, and then the arms 3 fit into the top of the back rest tubes 2 and the front of the arms clip into the front tubes 9 located on the front top legs 28-10 of the chair. The toilet seat 6 is bolted to the aluminium seat 8.

The retractable shower support, prior to use will normally is in a knocked down state as shown in FIG. 2, with the chair removed for ease of storage and transportation. To use, the retractable shower support is unfolded by extending, in rotational motion about the hinge mechanism, the two portions of the elongate frame member so that they align in the same horizontal plane as shown in FIG. 4. The extended frame is then inserted in to the shower cavity such that one of the elongate frame portions is positioned within the cavity and the other portion extends outside the shower cavity. At this stage the support legs can be adjusted to level the retractable shower support. The chair is then attached to the slidable platform by positioning one of the chair legs to one of the chair leg supports on the platform. In this state the chair can remain in a knockdown state, until desired to be used. To erect in a use state, the other leg is inserted into the other leg support. Once in the erect state the back rest, side arms and harness can be put into position. Also the foot rest 14 can be lowered into a horizontal position. The assembled retractable shower support is then able to be used. To load an invalid to the retractable shower support, the chair along with platform is slid to be positioned over the portion of the portion of the elongate frame outside the shower cavity. The chair and platform are able to be rotated to accommodate the placement of the invalid into the chair. If required the invalid can then be harnessed to the chair in order to restrain the invalid therein to prevent injury to the invalid and/or the caregiver. Once mounted the invalid is slid by sliding the chair and platform along the tracks of the elongate frame member into the shower cavity such that the invalid, chair and platform are positioned above the portion of the elongate frame member within the shower cavity. Once showering is complete the patient is removed from the shower cavity, dried and removed from the chair. When not in use the retractable shower support can be disassembled and stored or transported to another locality for use by another invalid.

List of Components and Items Used in Drawings:

1. Aluminium tube to fix chair back rest into
2. Aluminium tube welded to back rest to fit arms into
3 Aluminium chair arms platform
4 Slots cut in back rest to fit restraining strap
5. Rubber pad for back comfort
6. Plastic toilet seat
7. Hole in aluminium seat for easy self cleaning
8. Aluminium seat
9. Aluminium tube to fit to front of chair
10. Aluminium inner chair leg
11. 10 mm stainless steel lock nut to fix chair legs together
12. Aluminium outer chair leg
13. Tubular bottom support for chair leg
14. Foot rest platform
15. Aluminium track for chair wheels
16. Right aluminium foot level adjustment support
17. Aluminium end cap for track
18. Rubber foot with 12 mm stainless nut molded into for easy removal and replacement
19. 50×3 mm aluminium angle cross member for strength
20. 12 mm stainless steel threaded rod for leveling chair
21. Left aluminium foot level adjustment support
22. Aluminium lock for tubular bottom support into top platform
23. Top platform to sit chair on
24. Ultra wpe plastic for 360 degree rotation of chair
25. Aluminium outer chair leg
26. 10 mm stainless steel bolt to fix chair legs together
27. Aluminium angle iron to support track from bending
28. Aluminium inner chair leg
29 Clip bearing to hold arm to chair
30. 20 mm stainless bolt to allow rotation of top platform
31. Woman sitting on shower chair
32. Shower door
33. Stainless steel locking pin to lock front and back tracks together
34. 12 mm locking nut to prevent feet from moving
35. Hinge to fold unit together and to take front off to close shower door
36. Handle to pick up unit
37. 12 mm locking unit to prevent feet from moving
38. Left aluminium angle 50×50×4 mm bottom platform support
39. Stainless steel 90 mm butt hinge for front foot rest to raise up and down
40. Right 50×50×4 mm angle to support for foot platform
41. Left 50×50×4 mm angle to support for foot platform
42. Plastic wheel to run platform up and down track
43. 10 mm lock nut to prevent wheel coming off
44. Bottom aluminium platform
45. Stainless steel wheel shaft
46. Right 50×50×4 mm angle to support bottom platform
47. Aluminium rivets to hold together
48. Stainless steel washer
49. Seat tubes
50. Back rest Replacement of Parts 1. The track can be replaced with stainless steel
2. The material used to construct the retractable shower mate can be replaced with a lighter and stronger material
3. The nylon wheels can be replaced with stainless steel ball bearings
4. The chair seat and back can be made of plastic Commercial Advantages 1. Time saver
2. No back injuries for caregivers
3. Cost affective
4. Light weight
5. Transportable
6. Compact
7. Easily constructed
8. Environmentally friendly
9. Easily recycled
10. Aesthetically pleasing
11. Robust Variations Throughout the description of this specification the word "comprise" and variations of that word such as "comprises" and "comprising", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is herein set forth and as claimed in the appended claim set.

I claim:

1. A retractable shower support, typically a retractable shower chair, structured for moving an invalid in and out of a shower, wherein the retractable shower support comprises:

(i) at least a pair of elongate frame members, wherein the elongate frame members are connectable to one another whereby, when the elongate frame members are in an erected position, upper surfaces of the elongate frame members are aligned in a same plane and at least one of the pair of elongate frame members is adapted to extend into a shower cavity, (ii) a platform having an upper platform portion and a lower platform portion rotatably connected to one another, the lower portion slidably mounted in a track of the elongate frame members to enable the platform to be slid back and forth along the elongate frame members and enable the upper portion to rotate with respect to the lower portion so the upper portion can be rotated 360° relative to the elongate frame members to allow rotational mobility within the shower, and (iii) a support means having a seat portion spaced apart a distance from the upper surface of the platform by a depending means that is releasably captured to the upper surface of the platform so that the support means is adapted to be detached from the platform, wherein, when the elongate frame members are in an erected position and the support means is in an upright position when in use, the support means is adapted to be slid back forth along the elongate frame members so as to be moved in to and out of the shower cavity.

2. The retractable shower support as claimed in claim 1, wherein wheels mounted to the platform are adapted to move back and forth in the track so as to allow the support means to be retracted in and out of the shower cavity.

3. The retractable shower support as claimed in claim 2, wherein the each elongate frame member has at least two support legs connected to the under surface of each respective elongate frame member wherein the support legs are adapted to support the elongate frame members at a predetermined height above the floor and above the highest most point of a shower tray.

4. The retractable shower support as claimed in claim 3, wherein at least one of the support legs of each elongate frame member is adapted to be adjusted vertically so that height of the retractable shower support is adapted to allow the retractable shower support to be level.

5. The retractable shower support as claimed in claim 4, wherein all support legs are adjustable.

6. The retractable shower support as claimed in claim 5, wherein the platform has an aperture therein so water can easily pass therethrough.

7. The retractable shower support as claimed in claim 6, wherein the platform has a foot rest attached thereto structured for resting feet and preventing feet from being injured when moving the support means in and out of the shower.

8. The retractable shower support as claimed in claim 7, wherein the elongate frame member is hinged at the centre to allow the elongate frame member to be folded in half for storing and transportation.

9. The retractable shower support as claimed in claim 2, wherein the wheels are nylon wheels or ball bearing wheels.

10. The retractable shower support as claimed in claim 1 wherein the elongate frame members are connectable together.

11. The retractable shower support as claimed in claim 10, wherein the support means is a chair having a seat, four legs depending downward from the seat, a back support and two arm rests.

12. The retractable shower support as claimed in claim 11, wherein the seat, legs and back support are pivotably connected to one another.

13. The retractable shower support as claimed in claim 12, wherein back legs of the chair are releasably secured to the upper portion of the platform and the front legs releasably secured to the upper portion of the platform, wherein the chair is adapted to be secured in the upright position when in use.

14. The retractable shower support as claimed in claim 13, wherein the seat is in the form of a toilet seat.

15. The retractable shower support as claimed in claim 14, wherein the toilet seat is removable for cleaning purposes and/or replacement thereof.

16. The retractable shower support as claimed in claim 15, wherein, the toilet seat or seat is made from plastic material.

17. The retractable shower support as claimed in claim 13, wherein the arm rests are removable.

18. The retractable shower support as claimed in claim 17, wherein the retractable shower support is made from lightweight, versatile and rigid materials.

19. The retractable shower support as claimed in claim 18, wherein the lightweight, versatile and rigid materials are either aluminum, titanium, steel, plastics material or any combination thereof.

20. A retractable shower support, typically a retractable shower chair, structured for moving an invalid in and out of a shower, the retractable shower support comprising:

(i) at least one elongate frame member having a track, (ii) a platform having an upper platform portion and a lower platform portion rotatably connected to one another, the lower portion slidably mounted in the track within which the platform is adapted to slide between a first position and a second position, (iii) a support means adapted to support an invalid, the support means having a seat portion spaced apart a distance from the upper surface of the platform by a depending means that is releasably captured to the upper surface of the platform so that the support means is adapted to be detached from the platform, wherein when in use, a first portion of the elongate frame member is adapted to extend into a shower cavity and a second portion of the elongate frame member is adapted to extend outside the shower cavity whereby upper surfaces of said first and second portions are aligned in the same plane, such that the support means is structured to have an invalid positioned thereon when the platform is at the first position when situated over the second portion of elongate frame member and the support means is structured to position the invalid within the shower cavity when the support means is slid to the second position situated over the first portion of the elongate frame member and, in the second position, the upper portion may rotate with respect to the lower portion so the support means can be rotated to allow rotational mobility within the shower cavity.

21. The retractable shower support as claimed in claim 20, wherein the first portion of the elongate frame member is connected to the second portion of the elongate frame member by a hinge mechanism such that the two portions of the elongate frame member are adapted to be folded about the hinge mechanism.

22. The retractable shower support as claimed in claim 21, wherein the hinge mechanism is adapted to be releasable to allow the two portions to be detached from one another either when the retractable shower is in use or not in use.

23. The retractable shower support as claimed in claim 1, wherein the elongate frame members are connected to one another by a hinge mechanism such that each elongate frame member is adapted to be pivoted about the hinge mechanism between a stowed position and the erected position, wherein the retractable shower support is adapted to be stowed, and wherein when the retractable shower support is not in use, the elongate frame members are folded in half about the hinge mechanism for storing and transportation of the retractable shower support.

24. The retractable shower support of claim 20, wherein when the retractable shower support is not in use, the elongate frame member is structured to be folded about a hinge mechanism pivotally connecting the first and second portions together so that retractable shower support is capable of being easily stowed and/or transported.

25. The retractable shower support as claimed in claim 1, wherein lower portion has a plastic member coupled to the lower portion to provide a 360 degree swivel for the upper portion.

26. The retractable shower support as claimed in claim 20, wherein lower portion has a plastic member coupled to the lower portion to provide a 360 degree swivel for the upper portion.

* * * * *

UNITED STATES PATENT AND TRADEMARK OFFICE

CERTIFICATE OF CORRECTION

PATENT NO. : 7,448,097 B2
APPLICATION NO. : 11/011305
DATED : November 11, 2008
INVENTOR(S) : Danny Cancian It is certified that error appears in the above-identified patent and that said Letters Patent is hereby corrected as shown below:

Column 1, line 20, “being placed placed in” should be --being placed in--.
Column 1, line 20, “caregivers” should be --caregivers.--.
Column 1, line 30, “big and very bully” should be --big and very bulky--.
Column 1, lines 32-33, “there homes” should be --their homes--.
Column 1, line 53, “a shower chain” should be --a shower chair--.
Column 1, line 61, “shower chair for moving” should be --shower chair, for moving--.
Column 3, line 11, “elongate free” should be --elongate frame--.
Column 4, line 29, “elongated fame” should be --elongated frame--.
Column 5, line 33, “ultra wipe” should be --ultra wpe--.
Column 5, line 39, “shower are” should be --shower and--.
Column 5, line 43, “invalids feet” should be --invalid’s feet--.
Column 5, line 44, “being slide along” should be --being slid along--.
Column 6, lines 13 and 14, “car-egiver” should be hyphenated as --care-giver--.
Column 6, line 23, “have piece of mind” should be --have peace of mind--.
Column 6, line 45, “to provided strength” should be --to provide strength--.
Column 6, line 48, “were the unit” should be --where the unit--.

Signed and Sealed this

Twenty-sixth Day of May, 2009

John Doll

JOHN DOLL
*Acting Director of the United States Patent and Trademark Office*